US006155467A

United States Patent [19]

Chen

[11] Patent Number: 6,155,467

[45] Date of Patent: Dec. 5, 2000

[54] TOY FIGURE SUPPORT DEVICE

[76] Inventor: Chao-Yang Chen, 8F-3, No. 321, Fu Shin S. Rd., Sec. 1, Taipei, Taiwan

[21] Appl. No.: 09/411,250

[22] Filed: Oct. 4, 1999

[51] Int. Cl.[7] ..... A47G 25/14; A47G 25/38

[52] U.S. Cl. ..... 223/85; 223/DIG. 4

[58] Field of Search ..... 223/85, 92, 88, 223/DIG. 4; D6/315

[56] References Cited

U.S. PATENT DOCUMENTS

| | | | |
|---|---|---|---|
| 1,181,691 | 5/1916 | Stiebritz | 223/85 |
| 2,355,705 | 8/1944 | Cohn | 223/85 |
| 5,201,443 | 4/1993 | Oswald | 223/85 |
| 5,503,311 | 4/1996 | Chen | 222/85 |
| 5,538,166 | 7/1996 | Ogawa et al. | 223/85 |
| 5,577,644 | 11/1996 | Chen | 223/85 |
| 5,601,219 | 2/1997 | Chen | 223/85 |

*Primary Examiner*—Bibhu Mohanty
*Attorney, Agent, or Firm*—Bacon & Thomas, PLLC

[57] ABSTRACT

A toy figure support device, which includes a socket, a toy figure surrounding covered on the socket, a plug, and a hanging device, wherein the socket has a top opening and an outward top flange; the toy figure has a cover and a through hole at the cover in alignment with the top opening of the socket; the plug is plugged into the socket, having an outward top flange pressing the cover of the toy figure against the outward top flange of the socket to secure the cover to the socket; the hanging device is coupled to the plug and extended out of the toy figure for hanging.

4 Claims, 10 Drawing Sheets

TOY FIGURE SUPPORT DEVICE

BACKGROUND OF THE INVENTION

The present invention relates to toy figures, and more specifically to the arrangement of a figure with attached accessories.

A toy figure is generally comprised of a soft cover having the shape of a particular design (for example, an animal or cartoon figure), and stuffing such as cotton, sponge, cloths, etc., packed in the cover. This kind of toy figure is attractive to many people due to the advantages of softness, cheap cost, and safety. In order to make other objects attractive, a toy figure may be added for decoration. For example, people may attach a toy figure to a hanger, clothes rack, shoe rack, etc. When decorating an object with a toy figure, the cover of the figure is directly fastened to the object by stitches, and then a hanging device, for example, a hanging rope is fastened to the figure for hanging. Because no frame means is provided inside the toy figure to support the figure in shape, the figure tends to be deformed when bearing a load. There is known a toy figure and hanger combination toy, which comprises a clothes hanger, and a toy figure surrounding the clothes hanger. The cover of the figure has a through hole through which the clothes hanger passes to the outside of the toy figure. Because the figure tends to be stretched, the peripheral area of the cover around the through hole tears easily. In order to eliminate the aforesaid problem, the present inventor invented a number of designs under U.S. Pat. No. 5,503,301, entitled "Rotating Clothes Hanger Covered with a Toy Doll"; U.S. Pat. No. 5,577,644 entitled "Toy Doll and Hanger Assembly"; U.S. Pat. No. 5,601,219 entitled "Clothes Hanger Covered with a Toy Doll".

SUMMARY OF THE INVENTION

The present invention has been accomplished under the circumstances in view. According to one embodiment of the present invention, the toy figure support device comprises a socket, a figure surrounding the socket, a plug, and a hanging device, wherein the socket has a top opening and an outward top flange; the figure has a cover and a through hole in the cover in alignment with the top opening of the socket; the plug is plugged into the socket, having an outward top flange pressing the cover of the toy figure against the outward top flange of the socket to secure the cover to the socket; the hanging device is coupled to the plug and extended out of the figure for hanging. A connecting tube may be connected to the socket for the positioning of a utility item. The utility item can be a clothes rack, a hook, a suit rack, a sock rack, a shoe rack, etc. The connection between the connecting tube and the attached rack can be referred to U.S. Pat. No. 5,577,644. The hanging device can be a hanging rope, hanging hook, hanging ring, or any of a variety of devices suitable for hanging the toy figure on a support. The plug is provided for the installation of the hanging device and the connecting tube. Because the periphery of the cover of the toy figure around the through hole is secured in between the outward top flange of the socket and the outward top flange of the plug, the cover does not tear easily when the toy figure bears a load.

DETAILED DESCRIPTION OF THE PREFERRED EMBODIMENT

Figure 1:
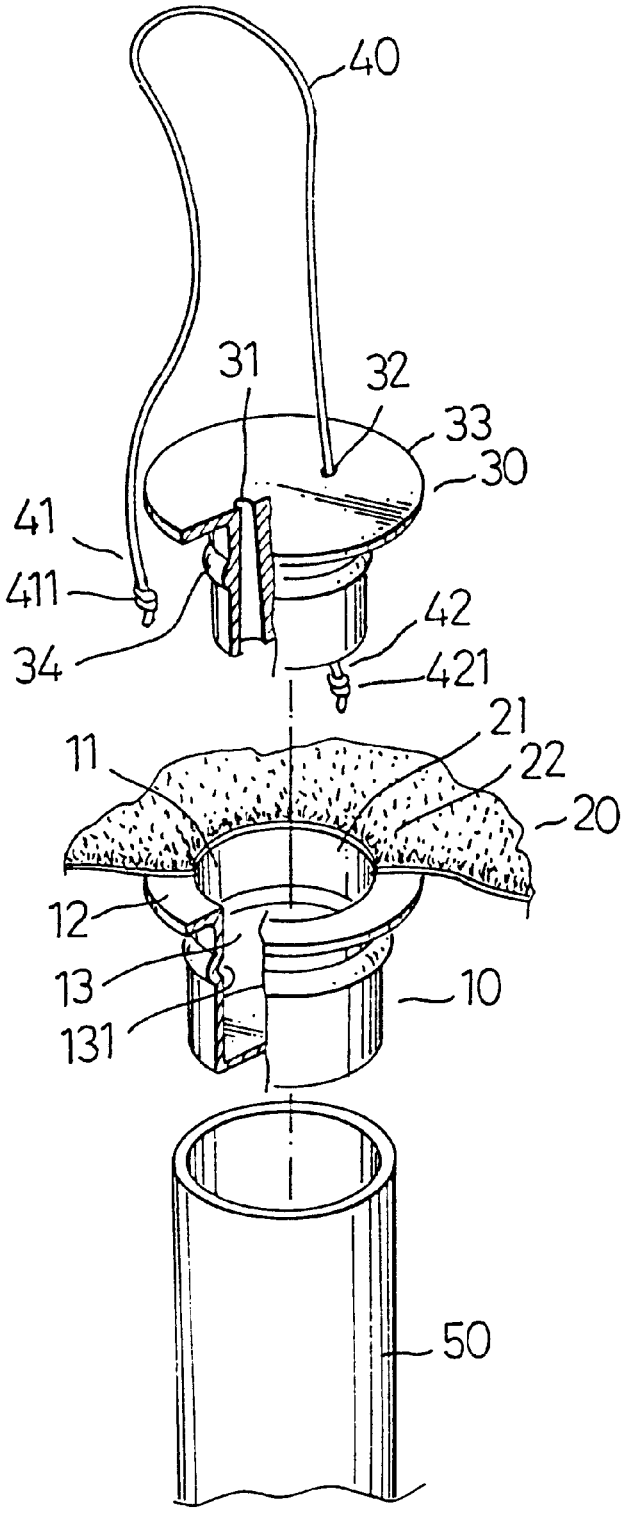
FIG. 1 is an exploded view of a first embodiment of the present invention.

Referring to FIG. 1, a toy figure support device according to a first embodiment of the present invention is shown comprised of a socket 10, a toy figure 20 surrounding on the socket 10, a plug 30, and a hanging device 40.

The socket 10 comprises a top opening 11, an outward top flange 12, a receiving chamber 13, and an inside annular groove 131 disposed on the inside around the receiving chamber 13. A connecting tube 50 can be connected to the socket 10 for the positioning of a clothes hanger, shoe rack, hanger ring, etc. (not shown). The plug 30 is plugged through the top opening 11 into the receiving chamber 13 in the socket 10 to hold down the toy figure 20, comprising an outward top flange 33, and an outside annular flange 34 raised around the periphery and forced into engagement with the inside annular groove 131 in the receiving chamber 13 of the socket 10. The toy figure 20 has a through hole 21 through which the plug 30 is inserted into the top opening 11 and receiving chamber 13 in the socket 10, enabling the cover 22 of the toy figure 20 to be secured in between the outward top flange 12 of the socket 10 and the outward top flange 33 of the plug 30. The hanging device 40 is a flexible member, for example, a hanging rope coupled to the plug 30.

The plug 30 comprises two tapered through holes 31 and 32. The flexible hanging device 40 has a first end 41, and a second end 42. The first end 41 and the second end 42 are respectively inserted into the tapered through holes 31 and 32 at the plug 30, and then formed with a respective head 411 or head 421, enabling the first end 41 and the second end 42 to be respectively secured to the tapered through holes 31 and 32 at the plug 30.

Figure 2:
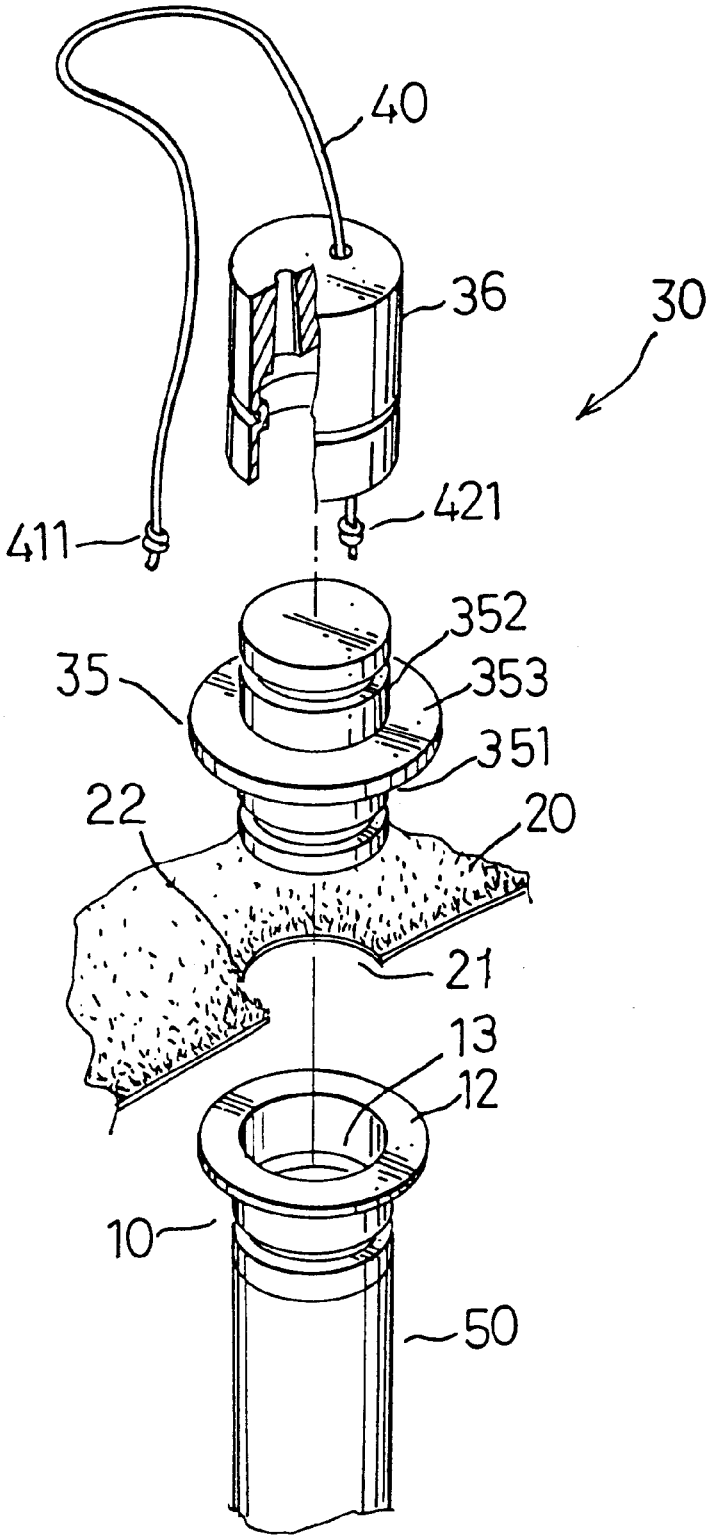
FIG. 2 is an exploded view of a second embodiment of the present invention.

FIG. 2 shows a toy figure support device according to a second embodiment of the present invention. According to this embodiment, the plug 30 is comprised of a plug body 35, and a cap 36. The plug body 35 comprises a bottom coupling rod 351 plugged into the through hole 21 at the toy figure 20 and the receiving chamber 13 in the socket 10, a collar 353 securing the cover 22 of the toy figure 20 against the outward top flange 12 of the socket 10, and a top coupling rod 352 coupled to the cap 36.

Figure 3:
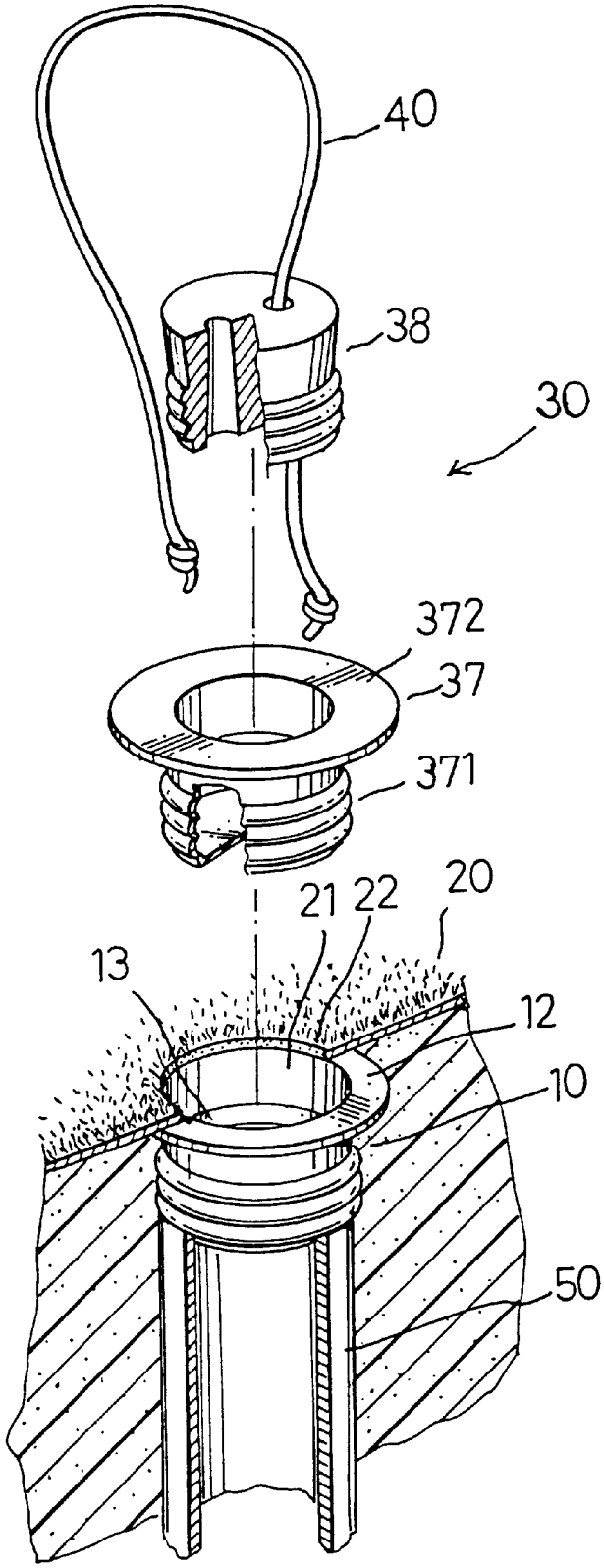
FIG. 3 is an exploded view of a third embodiment of the present invention.
Figure 4:
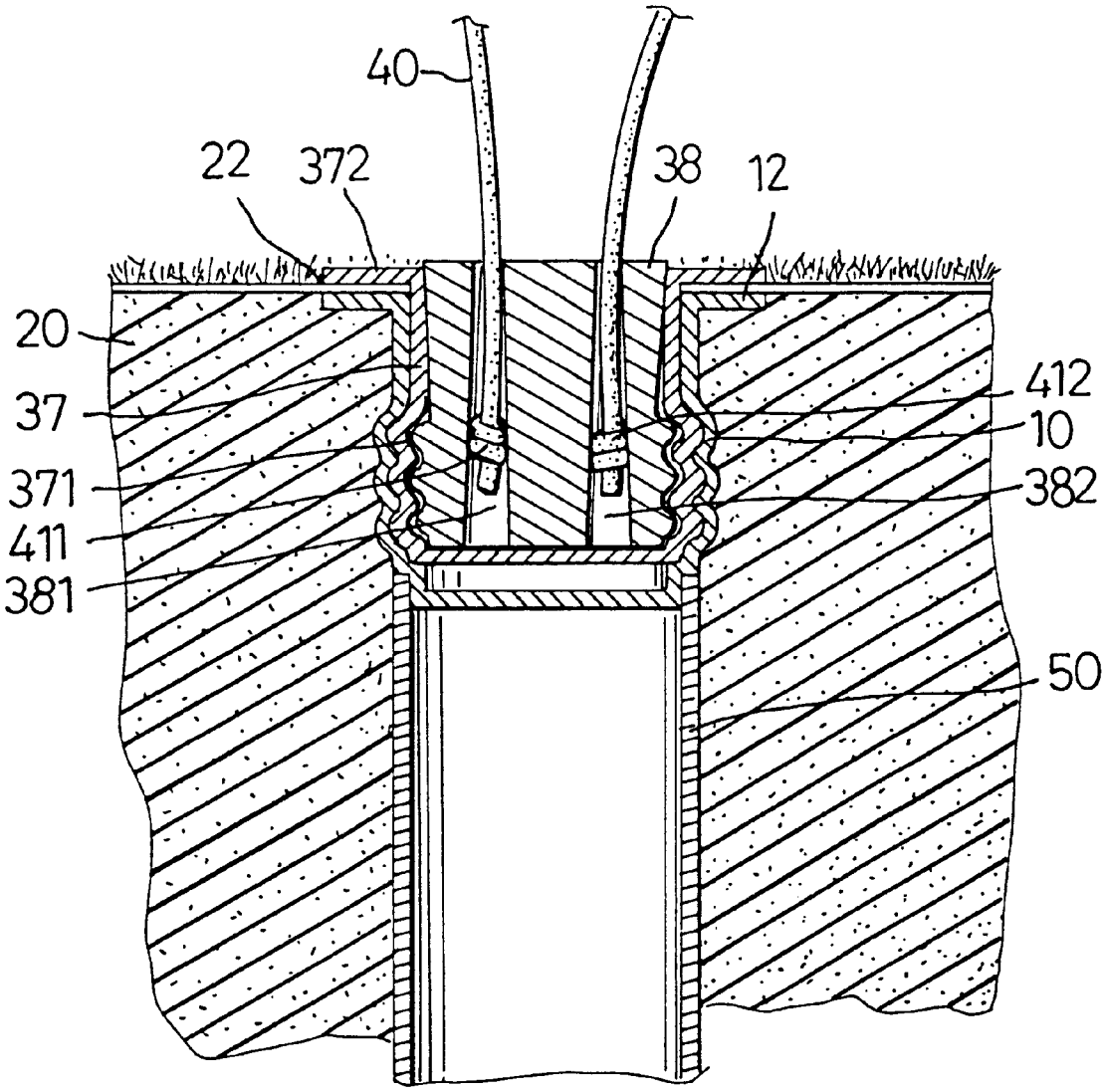
FIG. 4 is a sectional assembly view of the third embodiment shown in FIG. 3.

FIGS. 3 and 4 show a toy figure support device according to a third embodiment of the present invention. According to this embodiment, the plug 30 is comprised of a plug shell 37, and a plug rod 38. The plug shell 37 has a hollow cylindrical body 371 inserted through the through hole 21 at the toy figure 20 into the receiving chamber 13 in the socket 10, and an outward top flange 372 raised around the topmost edge of the hollow cylindrical body 371 and securing the cover 22 against the outward top flange 12 of the socket 10. As illustrated in FIG. 4, the heads 411 and 412 of the flexible hanging device 40 are respectively positioned in two tapered through holes 381 and 382 at the plug rod 38.

Figure 5:
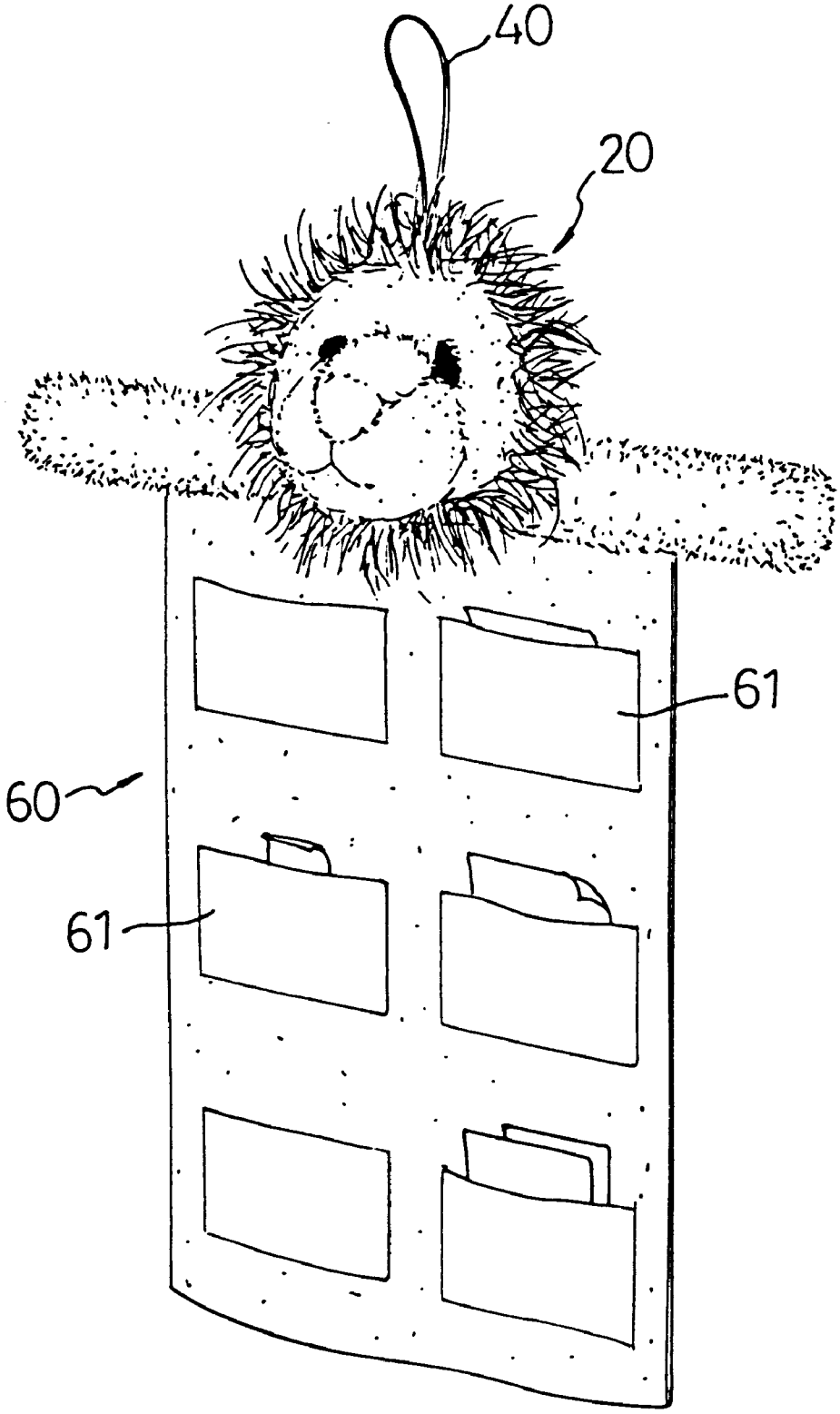
FIG. 5 shows an application example of the present invention, where an organizer is coupled to the toy figure.

Figures from 5 through 10 show different application examples of the present invention. As illustrated in FIG. 5, an organizer 60 is fastened to the toy figure 20 at the bottom side, having a plurality of pockets 61 for keeping things, and a hanging device 40 is extended out of the toy figure 20 for hanging.

Figure 6:
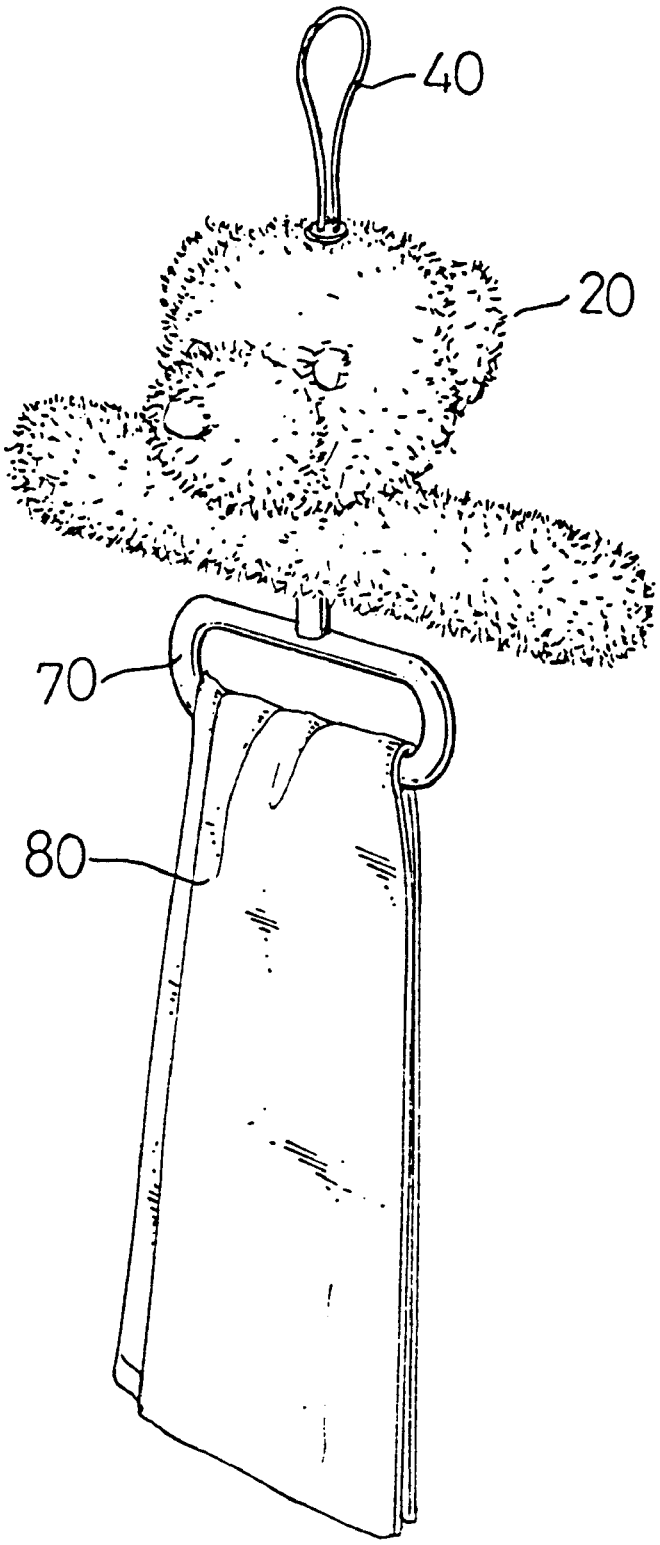
FIG. 6 shows another application example of the present invention, where a hanger ring is coupled to the toy figure to hold a towel.

Referring to FIG. 6, a hanger ring 70 is coupled to the toy figure 20 at the bottom side for holding a towel 80.

Figure 7:
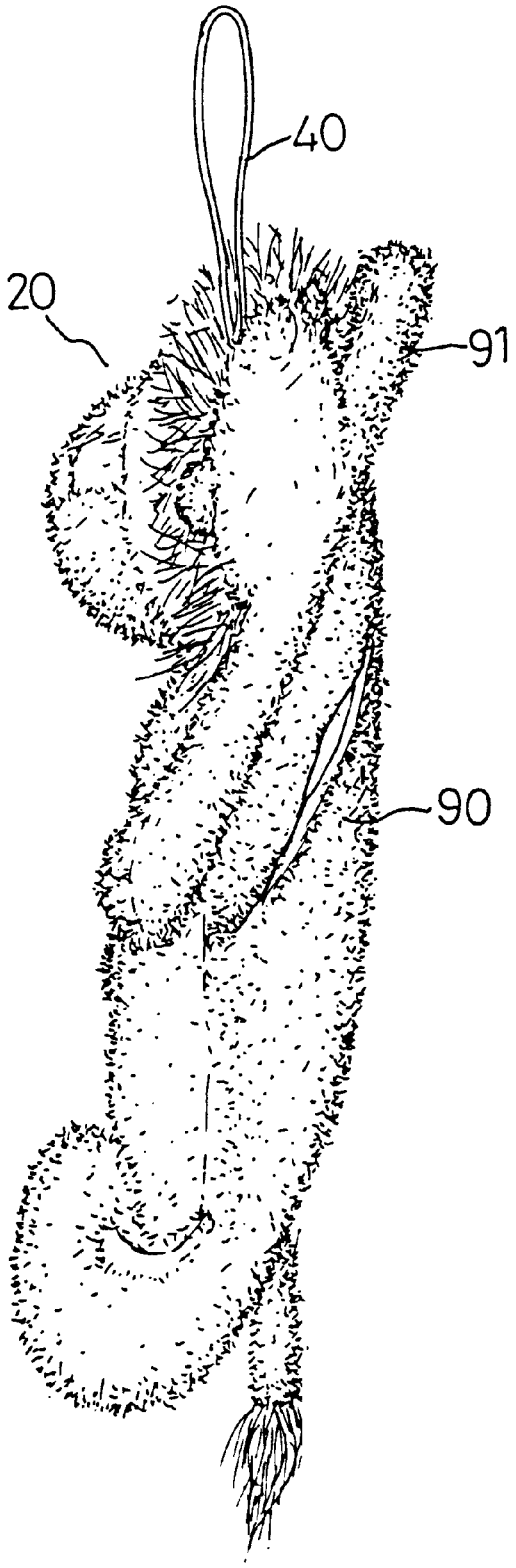
FIG. 7 shows still another application example of the present invention, where a pajamas bag is coupled to the toy figure.

Referring to FIG. 7, a clothes hanger 91 and a pajamas bag 90 are coupled to the toy figure 20 for hanging clothes and holding pajamas.

Figure 8:
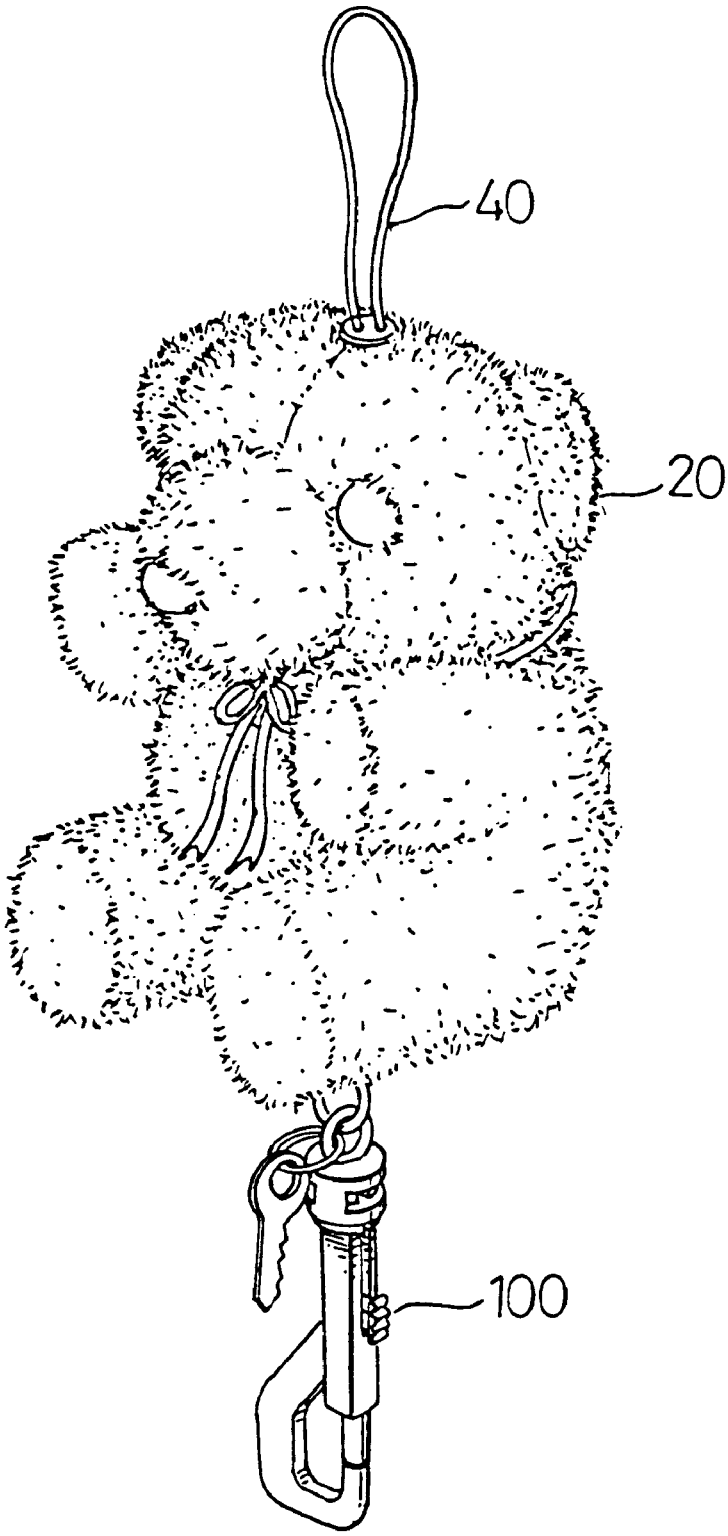
FIG. 8 shows still another application example of the present invention, where a key ring is coupled to the toy figure.

Referring to FIG. 8, a key ring 100 is coupled to the toy figure 20 at the bottom side for holding keys, and a flexible hanging device 40 is extended out of the toy figure 20 at the top side for hanging.

Figure 9:
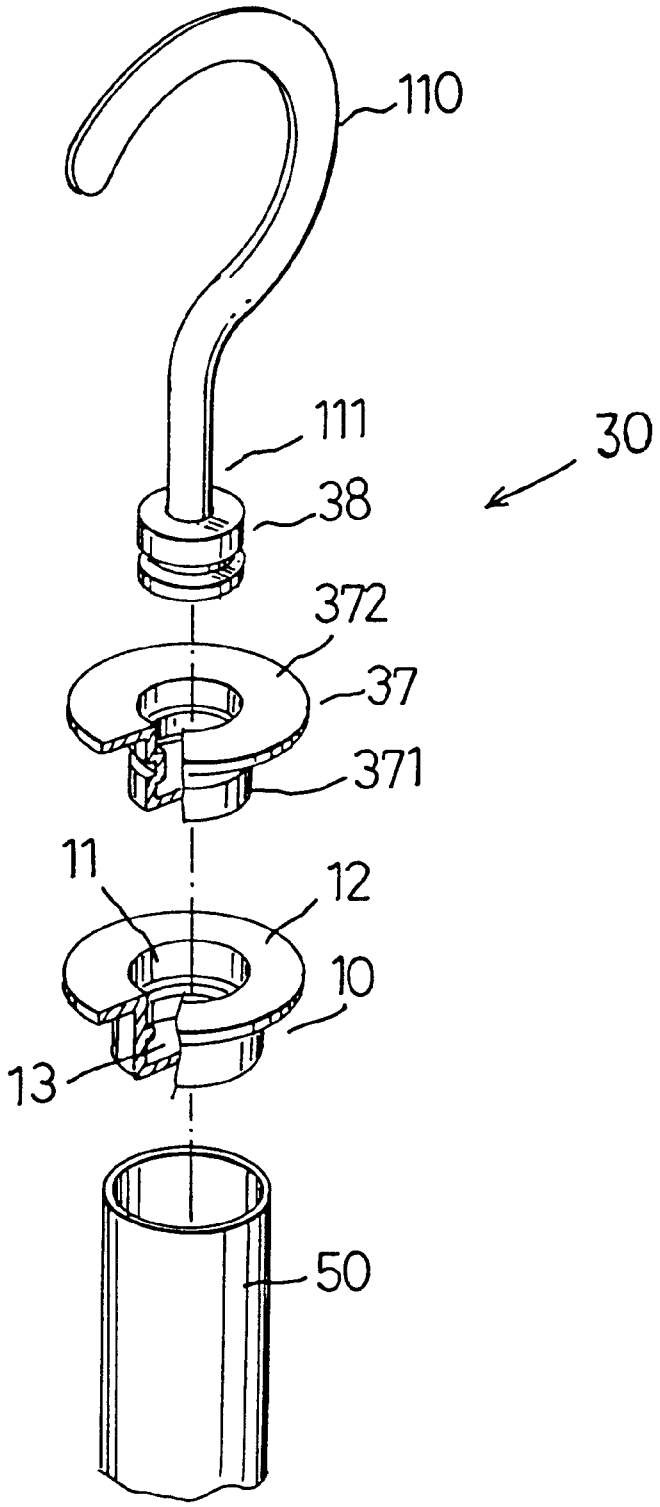
FIG. 9 is an exploded view of an alternate form of the present invention, showing a hook formed integral with the plug rod of the plug.
Figure 10:
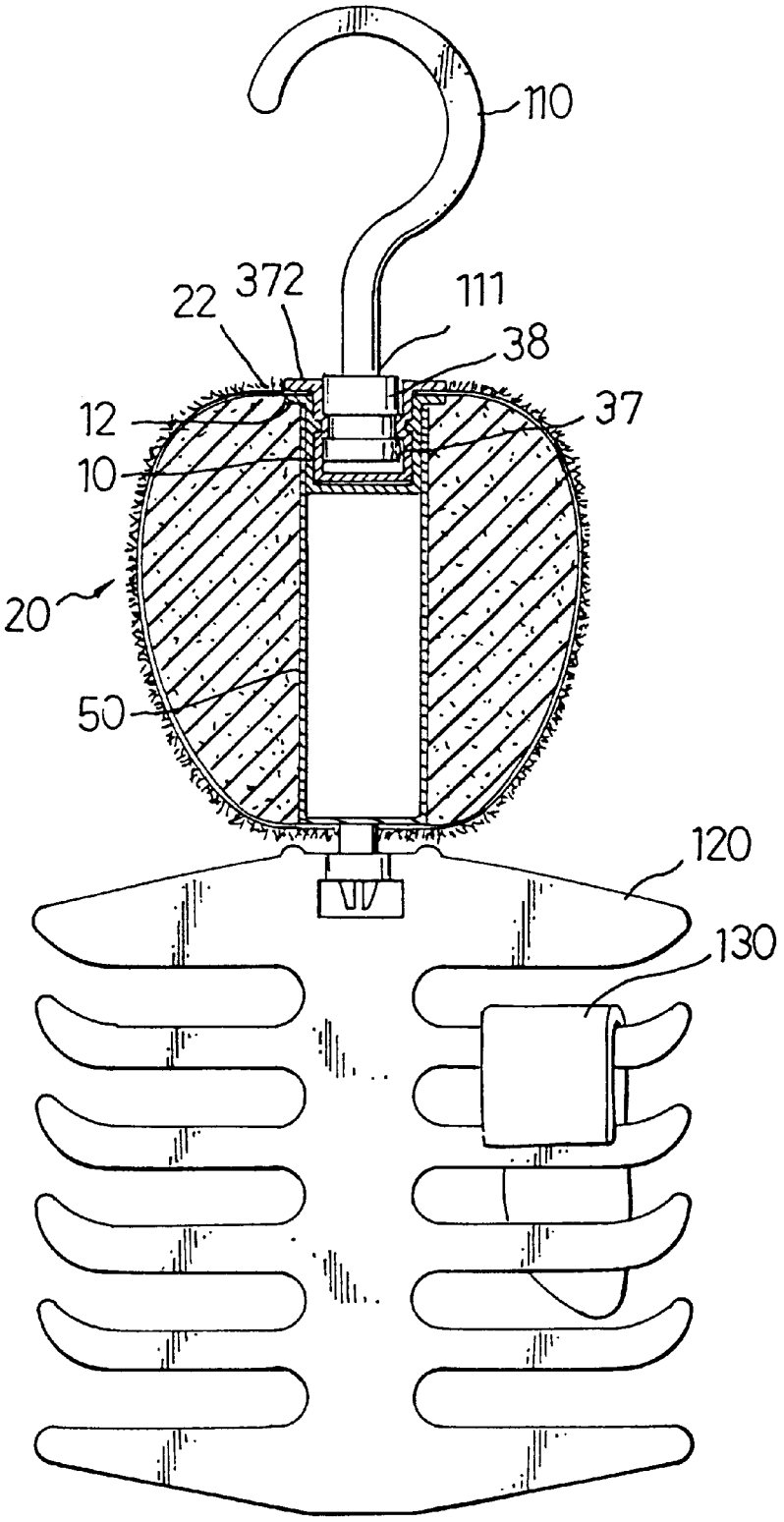
FIG. 10 shows still another application example of the present invention, where a rack is coupled to the connecting tube at the bottom side of the socket for holding socks.

Referring to FIGS. 9 and 10, the plug 30 is comprised of a plug shell 37, and a plug rod 38. The hanging device 110 is a hook. The plug rod 38 is formed integral with the bottom end 111 of the hook 110. The plug shell 37 has a hollow cylindrical body 371 inserted into the receiving chamber 13 in the socket 10, and an outward top flange 372 raised around the topmost edge of the hollow cylindrical body 371 and securing the cover 22 of the toy figure 20 against the outward top flange 12 of the socket 10.

Referring to FIG. 10 again, a connecting tube 50 is fastened to the socket 10 to hold a rack 120 for hanging socks 130. When a number of socks 130 are hung on the rack 120, the load does not stretch the toy figure 20, and the toy figure 20 is maintained in shape.

It is to be understood that the drawings are designed for purposes of illustration only, and are not intended for use as a definition of the limits and scope of the invention disclosed.

What is claimed is:

1. A toy figure support device comprising:

a socket including a top opening and an outward top flange;

a toy figure surrounding the socket, the toy figure including a cover and a through hole at the cover in alignment with the top opening of the socket;

a plug engaged within the through hole of the cover of the toy figure and the top opening of the socket for securing the cover of the toy figure to the socket, the plug having an outward top flange securing the cover of the toy figure against the outward top flange of the socket;

a hanging device coupled to the plug and extending out of the toy figure for hanging the toy figure; and wherein the plug further includes at least one tapered through hole, and the hanging device includes a rope having at least one head at one end thereof secured to the at least one tapered through hole.

2. The toy figure support device of claim 1 wherein the plug includes two tapered through holes, and the hanging rope includes two distal ends, each distal end having a head, and the two heads being fastened to the two tapered through holes of the plug.

3. A toy figure support device comprising:

a socket including a top opening and an outward top flange;

a toy figure surrounding the socket, the toy figure including a cover and a through hole at the cover in alignment with the top opening of the socket;

a plug engaged within the through hole of the cover of the toy figure and the top opening of the socket for securing the cover of the toy figure to the socket, the plug having an outward top flange securing the cover of the toy figure against the outward top flange of the socket;

a hanging device coupled to the plug and extending out of the toy figure for hanging the toy figure;

the plug further including a plug body and a cap, the plug body having a bottom coupling rod plugged into the through hole of the toy figure and the top opening in the socket, a collar securing the cover of the toy figure against the outward top flange of the socket, and a top coupling rod coupled to the cap; and wherein the cap of the plug includes two tapered through holes, and the hanging device is a hanging rope having two distal ends, each distal end including a head, and the two heads being fastened to the two tapered through holes.

4. A toy figure support device comprising:

a socket including a top opening and an outward top flange;

a toy figure surrounding the socket, the toy figure including a cover and a through hole in the cover in alignment with the top opening of the socket;

a plug engaged within the through hole of the cover of the toy figure and the top opening of the socket for securing the cover of the toy figure to the socket, the plug having an outward top flange securing the cover of the toy figure against the outward top flange of the socket;

a hanging device coupled to the plug and extending out of the toy figure for hanging the toy figure;

the plug including a plug shell plugged through the through hole of the toy figure and into the top opening of the socket, a plug rod plugged into the plug shell, the plug rod having two tapered through holes; and the hanging device includes a rope having two distal ends, each end having a head, the two heads being fastened to the two tapered through holes of the plug rod.

* * * * *